US011474465B2

(12) United States Patent
Tsukada et al.

(10) Patent No.: US 11,474,465 B2
(45) Date of Patent: Oct. 18, 2022

(54) IMAGE FORMING APPARATUS INCLUDING A DEVELOPING DEVICE THAT DEVELOPS AN ELECTROSTATIC LATENT IMAGE

(71) Applicant: CANON KABUSHIKI KAISHA, Tokyo (JP)

(72) Inventors: Yoshiro Tsukada, Chiba (JP); Takehiro Kojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/065,163

(22) Filed: Oct. 7, 2020

(65) Prior Publication Data

US 2021/0109470 A1 Apr. 15, 2021

(30) Foreign Application Priority Data

Oct. 11, 2019 (JP) ..... JP2019-187211
Oct. 11, 2019 (JP) ..... JP2019-187212
Aug. 5, 2020 (JP) ..... JP2020-132815

(51) Int. Cl.
*G03G 15/00* (2006.01)
*G03G 15/02* (2006.01)
*G03G 15/10* (2006.01)

(52) U.S. Cl.
CPC ..... *G03G 15/50* (2013.01); *G03G 15/0216* (2013.01); *G03G 15/105* (2013.01); *G03G 2215/0658* (2013.01)

(58) Field of Classification Search
CPC ..... G03G 15/11; G03G 15/10; G03G 15/104; G03G 15/105; G03G 2215/0658; G03G 21/0088
See application file for complete search history.

(56) References Cited

U.S. PATENT DOCUMENTS 6,512,907 B2 * 1/2003 Nishikawa ..... G03G 15/11 399/233
2012/0093530 A1 * 4/2012 Fukumoto ..... G03G 15/0815 399/53
2012/0201555 A1 * 8/2012 Nishiyama ..... G03G 15/11 399/55
2014/0348526 A1 * 11/2014 Lopez ..... G03G 15/55 399/57
2017/0212455 A1 * 7/2017 Portnoy ..... G03G 15/101
2017/0364012 A1 * 12/2017 Okumura ..... G03G 15/105
2018/0231922 A1 * 8/2018 Nelson ..... G03G 9/13
2019/0278208 A1 9/2019 Kojima

* cited by examiner

*Primary Examiner* — Jessica L Eley
(74) *Attorney, Agent, or Firm* — Canon U.S.A., Inc. I.P. Division

(57) ABSTRACT

In an image forming apparatus, in a case where a power of the apparatus is turned from OFF to ON, a rotation drive unit rotationally drives each of a developing roller, a first conductive roller, and a second conductive roller in a state where a liquid developer supplied to a developer container by a supply device has reached a supply position, and a bias application unit applies a bias to each of the developing roller, the first conductive roller, and the second conductive roller after the developing roller rotates at least once, in the state where the liquid developer supplied to the developer container by the supply device has reached the supply position.

6 Claims, 7 Drawing Sheets

IMAGE FORMING APPARATUS INCLUDING A DEVELOPING DEVICE THAT DEVELOPS AN ELECTROSTATIC LATENT IMAGE

BACKGROUND OF THE INVENTION

Field of the Invention

The present invention relates to an image forming apparatus including a developing device that develops an electrostatic latent image formed on an image bearing member with the use of a liquid developer including toner and a carrier liquid.

Description of the Related Art

An electrophotographic image forming apparatus (such as a copying machine, a printer, a facsimile machine or a multifunctional peripheral with functions of such apparatuses) is widely used that develops an electrostatic latent image formed on a latent image bearing member such as a photoreceptor with charged particles (toner) to form an image.

In electrophotography, developing processes as a process for forming an image on a latent image bearing member with toner particles are roughly classified into those of a dry developing type, in which toner particles are used as powder as it is, and those of a wet developing type, in which toner particles are dispersed in a liquid and used for image formation. Generally speaking, dry developers are used in most of electrophotographic technologies for use in offices or at home or for quick printing.

In order to obtain a high-definition print, it is advantageous to use a developer having a smaller particle size. However, as the particle size becomes smaller, the cohesive force between the particles becomes higher, making it difficult to maintain a suitable fluidity. Therefore, the lower limit of the particle size of the dry developer is about 5 μm.

On the other hand, the liquid developer, in which the behavior of toner particles is controlled in a liquid carrier, does not scatter and, since the particles are dispersed in the liquid, can maintain a sufficient fluidity. Thus, the liquid developer can have a particle size smaller than 1 μm, making it easy to obtain a high-quality image (see United States Patent Application Publication No. 2019/0278208). Therefore, in fields such as digital commercial printing where high-definition image quality is required, a wet developing method is a promising image forming process.

Here, the outline of the principles of image forming operation with a liquid developer on an image forming apparatus using a wet developing method for a developing device will be described.

In a wet developing type image forming apparatus, the liquid developer used for image formation is present in a developer mixing tank with an appropriate ratio between toner particles and a carrier liquid (weight percentage concentration of toner particles in the entire developer (wt %), hereinafter denoted by T/D). The T/D is adjusted by the supply of a concentrated toner with toner particles stored at a high filling rate (usually at a T/D of 20 wt % or more) and a liquid carrier. The liquid developer in the developer mixing tank is supplied through a developer supply port to a developer supply tank that supplies the developer to a developer carrier, by a supply pump.

In the developing device, toner particles included in the liquid developer are electrophoresed to form a film on the developer carrier, and fed to an image forming unit facing the latent image bearing member. Specifically, the liquid developer supplied to the developer supply tank is first borne on the surface of a roller-shaped developer carrier by the rotation of the developer carrier. After that, when passing through a facing section (gap of several hundred micrometers) between the developer carrier and a film-forming electrode, the toner is attracted toward the surface of the developer carrier by the action of the electric field generated by the potential difference between the film-forming electrode and the surface of the developer carrier.

After that, the liquid developer in the vicinity of the surface of the developer carrier is fed to a gap of several micrometers formed by a squeeze member, which is chiefly composed of a roller member and the developer carrier. In other words, the liquid developer is fed to a squeeze section. The developer carrier and the squeeze member are in contact with each other at an appropriate pressure when the developing device is not operating and the liquid developer does not intervene between the developer carrier and the squeeze member. When the developing device operates and the liquid developer is supplied from the upstream, the liquid developer flows between the developer carrier and the squeeze member due to the mutual rotation to form the gap.

In the squeeze section, the toner particles are electrophoresed by the action of the electric field generated by the potential difference between the squeeze member and the surface of the developer carrier when passing through the gap between the developer carrier and the squeeze member, and the toner is pressed against the surface of the developer carrier. As a result, a toner particle layer having a thickness about one to three times as large as the toner particle size is formed closest to the surface of the developer carrier, and a liquid carrier layer having a thickness of submicrometer to micrometer order is formed on top of the toner particle layer.

The liquid developer formed in a film on the developer carrier by the film-forming electrode and the squeeze member is fed to a developing section that is a facing section, where the developer carrier faces the latent image bearing member, and image formation is performed. In the developing section, based on the potential difference formed by the latent image made on the latent image bearing member, the toner particles on the developer carrier move onto the latent image bearing member by electrophoresis in the image region, and the toner particles in the non-image region pass through the image forming unit while attracted to the developer carrier. Through the process, the electrostatic latent image made on the latent image bearing member is visualized by toner particles.

In the developing section, the developer carrier and the latent image bearing member are brought into contact with each other at an appropriate pressure and, due to the rotation operations of the developer carrier and the latent image bearing member, the developer layer on the developer carrier flows in between the developer carrier and the latent image bearing member while forming a gap.

The toner image formed on the latent image bearing member is subsequently fed onto a medium by electrophoresis through processes of primary transfer and secondary transfer, and is fixed on the medium by a fixing means.

Toner particles that do not contribute to image formation and remain on the developer carrier are collected by a cleaning member provided downstream. The cleaning member is mainly composed of a roller member facing the developer carrier. The toner particles fed to a gap between the developer carrier and the cleaning member, that is, a cleaning section are electrophoresed such that it moves from the developer carrier to the cleaning member by the action of the electric field between the developer carrier and the cleaning member and separated thereby from the developer carrier. Here again, similarly to the squeeze section, the developer carrier and the cleaning member are in contact with each other at an appropriate pressure when the developing device is not operating and the liquid developer does not intervene between the developer carrier and the cleaning member. When the developing device operates and the liquid developer is supplied from the upstream, the liquid developer flows between the developer carrier and the cleaning member due to the mutual rotation operation to form the gap. The toner particles carried by the cleaning member are collected by the action of an additional cleaning member or the like, and returned to the developer mixing tank through a developer discharge port to be re-used.

The surface of the developer carrier bears a liquid developer newly supplied from the developer supply tank after the toner particles have been removed by the cleaning member as described above, and advances to the facing section, where the developer carrier faces the film-forming electrode.

In the wet developing type developing device as described above, rubber or a resin material having elastic mechanical properties is used for the surface layer of the developer carrier. The reason is that, in order to electrophorese toner particles in a desired direction in a gap formed at a place where the developer carrier and a roller-shaped member face each other, such as the squeeze section, the developing section, and the cleaning section, it is necessary to widen the contact width at each place to secure sufficient time for the electrophoresis of the toner particles. Therefore, in each facing section, the developer carrier and the roller-shaped member are in contact with each other at a strong pressure within a range that does not hinder the operation.

At each place where the developer carrier and the roller-shaped member face each other, the difference in moving speed, that is, the peripheral speed difference between the developer carrier and the member facing the developer carrier is set to an appropriate value according to each purpose. Generally in the developing section, in order to faithfully visualize the latent image formed on the latent image bearing member with toner particles, the peripheral speed difference between the developer carrier and the latent image bearing member is set to almost 0% within a range of plus/minus several percent. In the squeeze section, the peripheral speed difference is often adjusted within a range of plus/minus several hundred percent (−100% or less indicates a reverse rotation) for the purpose of optimizing the amount of the developer borne on the developer carrier.

While the liquid developer is constantly supplied to the surface of the developer carrier during the image forming operation, when the operation is stopped, toner particles are removed from the developer carrier and only the carrier liquid remains attached to the developer carrier. Immediately after the operation is stopped, the surface of the developer carrier is wet with the carrier liquid, but the carrier liquid evaporates from the surface of the developer carrier over time. Therefore, after the operation is stopped for a long time, when the power of the image forming apparatus is turned from OFF to ON, for instance, the surface of the developer carrier is dry.

In the wet developing method, a predetermined potential difference is generated between the developer carrier and each member in order to electrophorese toner. In this regard, the required potential difference is generally calculated from a nip passing time calculated from each nip width and a printing speed, as well as the migration capability of the toner. Normally, the potential difference applied to each nip during operation is several hundred volts to several kilovolts.

The material used for the surface layer of the developer carrier, which is conductive, is usually an elastic body (of rubber, for instance) including an ion conductive material or a carbon conductive material. It is generally known that a conductive roller including such materials deteriorates over time due to an electric field (resistance variation).

As described above, after the operation is stopped for a long time, when the power of the image forming apparatus is turned from OFF to ON, the surface of the developer carrier is dry, that is, after the operation is stopped for a long time, the liquid developer is not present in the facing section between the developer carrier and each contact member.

In the start-up operation of the developing device, in a case where a potential difference is formed in a state where the liquid developer is not present in the facing section between the developer carrier and each contact member, an electric current flows between the developer carrier and each contact member excessively as compared with the normal image formation in which a potential difference is generated in a state where the liquid developer is present in the facing section between the developer carrier and each contact member. As a result, the resistance of the elastic layer formed on the surface of the conductive developer carrier increases, and the life of the developer carrier may be shortened.

SUMMARY OF THE INVENTION

The present invention is directed at suppressing the reduction in life of a developer carrier by placing a liquid developer in a facing section between the developer carrier and each contact member, and then applying a bias to each of the developer carrier and the relevant contact member in the start-up operation of a developing device when a power of an image forming apparatus is turned from OFF to ON.

The present invention is also directed to an image forming apparatus an image bearing member, an exposure device configured to expose the image bearing member to light to form an electrostatic latent image on the image bearing member, and a developing device. The developing device includes a developing roller that is conductive and carries and feeds a liquid developer including toner and a carrier liquid to a developing position, where the electrostatic latent image formed on the image bearing member is developed, an elastic layer being formed on a surface layer of the developing roller, a developer container containing the liquid developer to be supplied to the developing roller, a first conductive roller contacting the developing roller, the first conductive roller being disposed downstream from a supply position on the developing roller, to which position the liquid developer is supplied from the developer container, and upstream from the developing position, in a rotation direction of the developing roller, and a second conductive roller contacting the developing roller, the second conductive roller being disposed downstream from the developing position and upstream from the supply position, in the rotation direction of the developing roller. The image forming apparatus also includes a supply device configured to supply the liquid developer to the developer container, a bias application unit configured to apply a bias to each of the developing roller, the first conductive roller, and the second conductive roller to generate an electric field in which a normally charged toner in the liquid developer moves from the first conductive roller toward the developing roller, at a first contact position where the developing roller and the first conductive roller are in contact with each other, and generate an electric field in which the normally charged toner in the liquid developer moves from the developing roller toward the second conductive roller, at a second contact position where the developing roller and the second conductive roller are in contact with each other, and a rotation drive unit configured to rotationally drive each of the developing roller, the first conductive roller, and the second conductive roller. In a case where a power of the image forming apparatus is turned from OFF to ON, the rotation drive unit rotationally drives each of the developing roller, the first conductive roller, and the second conductive roller in a state where the liquid developer supplied to the developer container by the supply device has reached the supply position, and the bias application unit applies the bias to each of the developing roller, the first conductive roller, and the second conductive roller after the developing roller rotates at least once in the state where the liquid developer supplied to the developer container by the supply device has reached the supply position.

Further features of the present invention will become apparent from the following description of exemplary embodiments with reference to the attached drawings.

DESCRIPTION OF THE EMBODIMENTS

Hereinafter, an embodiment for carrying out the present invention will be described with reference to the drawings.

In a first exemplary embodiment, one form of a developing device and an image forming apparatus to which the present invention is applied will be described.

[Developing Device]

First, the configuration of a developing device in the present exemplary embodiment will be described.

Figure 1A:
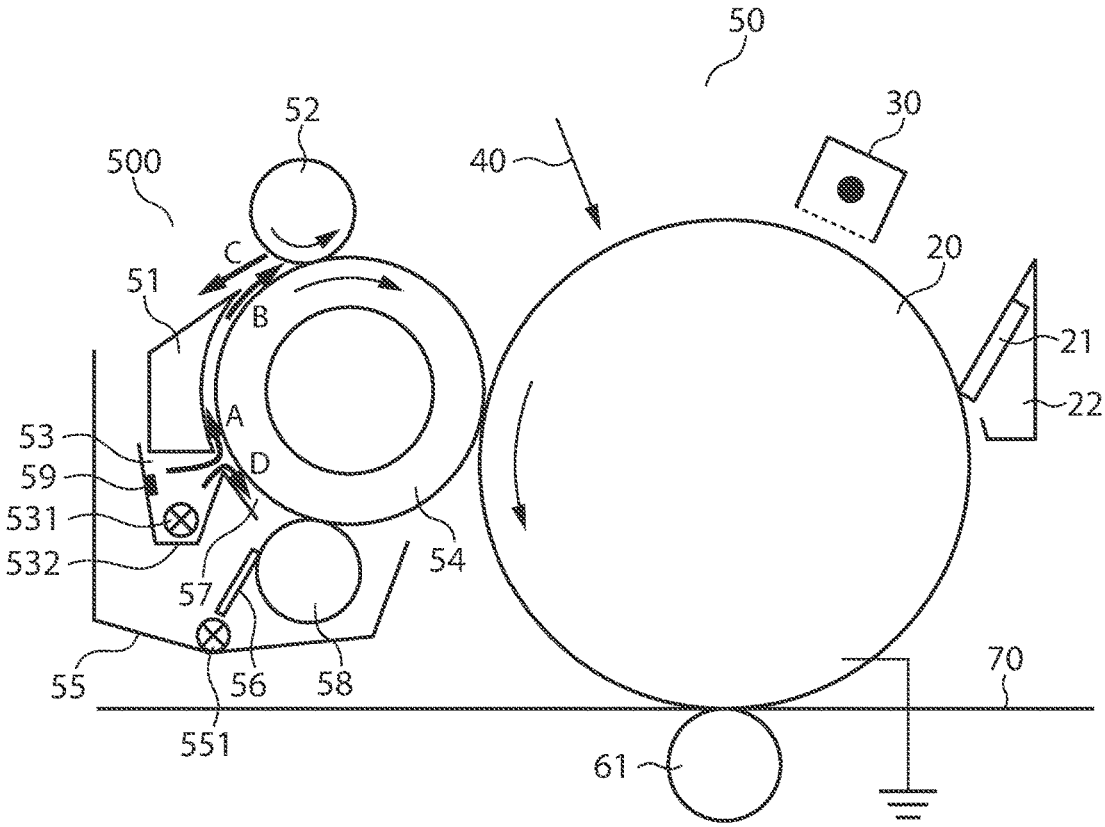
FIG. 1 is a cross-sectional view illustrating main components of a developing device and a liquid developer supply circulation system according to an exemplary embodiment of the present invention.
Figure 1B:
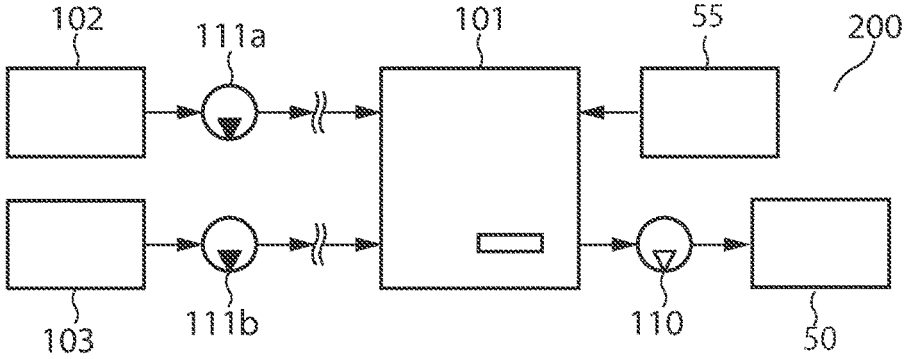

FIG. 1 is a cross-sectional view illustrating main components of a developing device 50. In the developing device 50, a developing roller 54 which is a developer carrier feeds a liquid developer to a photosensitive drum 20. The photosensitive drum 20 is a latent image bearing member. Centering on the developing roller 54, upstream of the surrounding photosensitive drum 20, a developer supply tank 53, a film-forming electrode 51, and a squeeze roller 52 are disposed. The developer supply tank 53 stores a developer solution. The film-forming electrode 51 attracts toner particles to the developing roller 54 side by the action of an electric field to carry a liquid developer from the developer supply tank 53 onto a developing roller 54. The squeeze roller 52 which is a squeeze member that further presses the toner particles included in the liquid developer carried on the developing roller 54, toward the developing roller 54 side by the action of an electric field and at the same time squeezes and collects an excess carrier liquid. On the downstream side, a developing cleaning roller 58 is disposed which is a first cleaning member. The developing cleaning roller 58 collects the toner particles on the developing roller 54 that did not contribute to image formation in the photosensitive drum 20, by the action of an electric field. A development unit 500 is formed by these members.

A voltage is applied to each of the developing roller 54, the film-forming electrode 51, the squeeze roller 52, and the developing cleaning roller 58 from a voltage application means (not illustrated). The toner particles in the liquid developer move by electrophoresis based on the potential difference of the voltage applied to each member. The movement amount and pressing amount of the toner particles are controlled by adjusting the potential difference between each member. In the present exemplary embodiment, the voltages applied to the developing roller 54, the film-forming electrode 51, and the squeeze roller 52 are all negative, and the voltage applied to the developing cleaning roller 58 is positive or negative.

The liquid developer used in the present exemplary embodiment is mainly obtained by adding particles having an average particle size of 0.7 μm, in which a coloring agent such as a pigment is dispersed in a polyester resin, to liquid carrier such as an organic solvent, together with a dispersant, a toner charge control agent, and a charge directing agent. The toner particles have a negative charge on the surface. The specific gravities of the toner particles and the carrier liquid are 1.35 g/cm$^3$ and 0.83 g/cm$^3$, respectively.

In the present exemplary embodiment, an image forming process speed is 785 mm/s, and the abovementioned roller-shaped members that contribute to image formation are each rotationally driven so that the surface peripheral speed is 785 mm/s.

The developing roller 54 is a cylindrical member having a diameter of 42.6 mm, and rotates clockwise about the central axis as illustrated in FIG. 1. The developing roller 54 includes an elastic body layer including a 4.3 mm thick conductive polymer or the like on the outer circumference of the inner core made of a metal such as stainless steel. That is, an elastic layer is formed on the surface of the conductive developing roller 54. Suitable materials used as the elastic member that constitutes the elastic layer are: an elastic member including as a base material a dispersion-type resistance adjusting resin which is obtained by mixing and dispersing any one or more types of conductive fine particles, such as carbon particles or titanium oxide particles, as an electrical resistance adjusting material into a resin selected from ethylene propylene dien monomer (EPDM), urethane, silicone, nitrile-butadiene rubber, chloroprene rubber, styrene-butadiene rubber, butadiene rubber, and the like; and an elastic member including as a base material an electrical resistance adjusting resin which is obtained by adding to the abovementioned resin, any one or more ion conductive materials, for example, an inorganic ion conductive agent, such as sodium perchloric acid, calcium perchloric acid, and sodium chloride.

In general, the elastic body layer is used in a range of the volume resistivity of $1\times10^2$ to $1\times10^{12}$ Ω·cm including variations, and more preferably $1\times10^5$ to $1\times10^9$ Ω·cm. In addition, in a case where a foaming agent is used in a forming/mixing process for obtaining elasticity, a silicon-type surface active agent (polydialsiloxane, a polysiloxane-polyalkylene oxide block copolymer) is suitably used. In general, the elastic body layer is used in a range where the hardness is 20° to 50°, more preferably 25° to 45° when measured with the use of a JIS standard durometer type A. The surface layer of the developing roller 54 in the present exemplary embodiment is a conductive urethane rubber. An ion conductive agent is dispersed inside the surface layer of the developing roller, and the volume resistivity is adjusted to $5\times10^6$ to $1\times10^8$ Ω·cm in the initial state. In addition, the hardness is adjusted to 25° to 30° in the initial state when measured with the use of the JIS standard durometer type A.

The developer supply tank 53 is a place for containing the liquid developer to develop the latent image formed on the photosensitive drum 20 in order to supply the liquid developer to the developing roller 54. A liquid developer having a concentration of toner particles appropriately adjusted in a developer mixing tank 101 (hereinafter, indicated by a weight percentage concentration [wt %] of toner particles in the developer, and abbreviated as T/D) is supplied. In the present exemplary embodiment, the T/D of the liquid developer in the developer mixing tank 101 is adjusted to 3.0±0.5 wt %, and the liquid developer is supplied from a developer supply port 531 to the developer supply tank 53 by the operation of a developer circulation pump 110. The configuration and operation around a liquid developer supply circulation system 200 will be described in detail separately.

The developer supply tank 53 is provided with a developer surface detection sensor 59 for detecting the surface of the liquid developer. Suppose that the liquid developer is supplied to the developer supply tank 53 from the developer supply port 531 by the operation of the developer circulation pump 110, and the height of the surface of the liquid developer in the developer supply tank 53 reaches the height of the detection surface of the developer surface detection sensor 59. In this case, the developer surface detection sensor 59 detects that there is a liquid developer, and the output of the developer surface detection sensor 59 changes from OFF to ON.

In addition, the developer supply tank 53 is provided with a flushing channel 57 and a developer discharge hole 532, which will be described below in detail. In a case where the supply of the liquid developer to the developer supply tank 53 is stopped, the liquid developer leaks from the developer discharge hole 532 provided on the bottom surface of the developer supply tank 53. Therefore, the amount of the contained liquid developer gradually decreases, and the developer supply tank 53 eventually becomes empty. Suppose that the liquid developer leaks from the developer discharge hole 532 provided on the bottom surface of the developer supply tank 53, and the height of the surface of the liquid developer in the developer supply tank 53 becomes lower than the height of the detection surface of the developer surface detection sensor 59. In this case, the developer surface detection sensor 59 detects that there is no liquid developer, and the output of the developer surface detection sensor 59 changes from ON to OFF.

The film-forming electrode 51 has a surface facing the developing roller 54 and having a circumferential length of 24 mm. A gap of 400±80 μm is formed between the film-forming electrode 51 and the developing roller 54. In a state of having reached a supply position on the developing roller 54, at which the liquid developer is supplied from the developer supply tank 53, the liquid developer supplied to the developer supply tank 53 is drawn into the gap between the film-forming electrode 51 and the developing roller 54 by the rotation of the developing roller 54 (arrow A in FIG. 1), and the toner particles are attracted to the developing roller 54 side by the electric field generated in the gap section due to the difference in the voltages applied to the film-forming electrode 51 and the developing roller 54. That is, at the facing position where the developing roller 54 and the film-forming electrode 51 face each other, an electric field is formed in which a normally charged toner in the liquid developer moves from the film-forming electrode 51 to the developing roller 54.

The squeeze roller 52 is a cylindrical member (conductive roller) including a metal, and in the present exemplary embodiment, a roller made of a stainless steel having a diameter of 16.8 mm is used. The squeeze roller 52 is brought into contact with the developing roller 54 so that the pressure may be constant (35±5 kPa in the present exemplary embodiment) over the long dimension (354 mm in the present exemplary embodiment), and rotates counterclockwise as illustrated in FIG. 1. Of the liquid developer that has been pumped up from the developer supply tank 53 and passed through the gap between the film-forming electrode 51 and the developing roller 54 and is fed to the facing section between the squeeze roller 52 and the developing roller 54 at a specified speed, the liquid developer present near the surface of the developing roller 54 intervenes between the squeeze roller 52 and the developing roller 54, and stably forms a nip with a gap of 1.5 to 2.0 μm and a width of 3 mm (arrow B in FIG. 1). In this nip, the toner particles are pressed against the developing roller 54 side by the electric field generated by the difference in the voltages applied to the squeeze roller 52 and the developing roller 54. That is, at a contact position where the developing roller 54 and the squeeze roller 52 contact each other, an electric field is formed in which a normally charged toner in the liquid developer moves from the squeeze roller 52 to the developing roller 54.

Near the exit of the nip between the squeeze roller 52 and the developing roller 54, the liquid developer separates to the surface of each roller. However, on the developing roller 54 side, almost all toner particles and carrier liquid present in the nip are carried to the developing roller 54 side, and only the carrier liquid is carried to the squeeze roller 52 side. Therefore, the T/D of the liquid developer layer formed on the developing roller 54 is more than 10 times higher than the T/D of the liquid developer in the developer supply tank 53.

In the present exemplary embodiment, after passing through the nip between the squeeze roller 52 and the developing roller 54, on the surface of the developing roller 54, a developer layer is formed in which the toner layer laminated to a volume fraction of approximately 60 vol % has a thickness of 1.0±0.05 μm, and the upper carrier liquid layer has a thickness of 0.3±0.05 μm. The T/D of the developer solution is 50±5 wt %.

Meanwhile, the liquid developer that does not enter the gap between the squeeze roller 52 and the developing roller 54 after passing through the gap between the film-forming electrode 51 and the developing roller 54 is repelled by the squeeze roller 52 and caused to flow to the back of the film-forming electrode 51 (arrow C in FIG. 1), and collected in a developer collection tank 55.

The liquid developer including the toner particle layer borne on the developing roller 54 forms a visible image as described in detail below, on the pattern of the latent image drawn on the photosensitive drum 20, at the facing section between the developing roller 54 and the photosensitive drum 20, that is, a developing section.

The photosensitive drum 20 is a cylindrical member which is wider than the width of the developing roller and has a photosensitive layer formed on the outer peripheral surface, and rotates counterclockwise as illustrated in FIG. 1. The photosensitive layer of the photosensitive drum 20 usually includes an organic photosensitive material, an amorphous silicon photoreceptor, or the like. In the present exemplary embodiment, the photosensitive drum 20 having a diameter of 84 mm is used, in which a photosensitive layer is formed by a mixture of an amorphous silicon and an amorphous carbon.

Around the photosensitive drum 20, a charging unit 30 that charges the photosensitive drum 20 along the rotation direction, and an exposure unit 40 that forms an electrostatic latent image on the charged photosensitive drum 20 are disposed upstream of the developing section.

The charging unit 30 is a device for charging the photosensitive drum 20. In the present exemplary embodiment, the charging unit 30 includes a corona charger, and applies a voltage of about −4.5 kV to −5.5 kV to a charging wire, thereby charging the surface of the photosensitive drum 20 to approximately −500 V. The exposure unit 40 includes a semiconductor laser, a polygon mirror, an F-θ lens, and irradiates the charged surface of the photosensitive drum 20 with a modulated laser to thereby form an electrostatic latent image. In the present exemplary embodiment, the latent image is formed by the exposure unit 40 so that the potential of an image region may approximately be −100 V.

The electrostatic latent image formed on the photosensitive drum 20 upstream of the developing section forms a visible image with toner particles in the developing section. In the developing section, in the present exemplary embodiment, a developing bias of approximately −300 V is applied to the developing roller 54. Based on the electric field formed by the electrostatic latent image (image region: −100 V, non-image region: −500 V) on the photosensitive drum 20, toner particles move onto the photosensitive drum 20 by electrophoresis in the image region, and the electric field acts in the direction in which the toner particles are pressed onto the developing roller, and thus the toner particles remain as they are on the developing roller in the non-image region. In this way, a visible image is formed on the photosensitive drum 20 by toner particles.

The toner particles that have moved to the photosensitive drum 20 in the developing section proceed to an image forming process in the downstream, and are primarily transferred to an intermediate transfer belt 70. In a primary transfer unit, the photosensitive drum 20 and the intermediate transfer belt 70 face each other, and a primary transfer back-up roller 61 is in contact with the back surface of the intermediate transfer belt 70. A voltage (+200 to +300 V in the present exemplary embodiment) having a polarity opposite to the charging property of the toner particles is applied to the primary transfer back-up roller 61, and the toner particle image formed on the photosensitive drum 20 moves onto the intermediate transfer belt 70 by electrophoresis. The carrier liquid and an amount as small as several percent of toner remain on the photosensitive drum 20. However, the remaining carrier liquid and toner are scraped off by a photoreceptor cleaning blade 21 disposed downstream of the primary transfer unit, and is collected by a photoreceptor cleaning liquid collection unit 22.

Meanwhile, the toner particles remaining on the developing roller 54 proceed to the process of collection and re-use. A developing cleaning roller 58 which is a first cleaning member is in contact with the developing roller 54 downstream of the developing section. The developing cleaning roller 58 is brought into contact with the developing roller 54 so that the constant pressure is put (80±5 kPa in the present exemplary embodiment) over the long dimension (354 mm in the present exemplary embodiment), and rotates counterclockwise in the cross section illustrated in FIG. 1. In the present exemplary embodiment, a roller (conductive roller) having a diameter of 16.8 mm made of a stainless steel (metal) is used as the cleaning roller. At the nip section between the developing roller 54 and the developing cleaning roller 58, an electric field is generated due to the difference in voltage applied to each of the developing roller 54 and the developing cleaning roller 58, and the toner particles on the developing roller 54, which have not contributed to the image formation in the developing section, plunge into the nip section, and almost all the toner particles move to the surface of the developing cleaning roller 58 by electrophoresis. That is, at a contact position where the developing roller 54 and the developing cleaning roller 58 contact each other, an electric field is formed in which a normally charged toner in the liquid developer moves from the developing roller 54 to the developing cleaning roller 58.

As illustrated in FIG. 1, the developing cleaning roller 58 is in contact with a developing cleaning roller cleaning blade (hereinafter simply referred to as a "cleaning blade") 56 as a second cleaning member. The cleaning blade 56 is a blade including a stainless steel having a thickness of 0.2 mm and a free length of 20 mm, and its tip abuts on the developing cleaning roller 58 in the counter direction and inclines by 30±3° from the vertical direction. The liquid developer containing toner particles collected on the surface of the developing cleaning roller 58 from the developing roller 54 is scraped off at the contact section with the developing cleaning roller 58 at the tip of the cleaning blade 56, and flows into the developer collection tank 55 through the slope of the cleaning blade 56.

The liquid developer collected in the developing cleaning roller 58 has different concentrations of toner particles (i.e., T/D) depending on the image formed in the developing section, and the maximum T/D is approximately 65 wt %, which is extremely high. In this case, the apparent viscosity of the liquid developer collected in the developing cleaning roller 58 rises up to approximately 140 mPa·s.

In a case where the liquid developer having such a high apparent viscosity is scraped off by the cleaning blade 56, it becomes difficult for the liquid developer to flow to the developer collection tank 55 through the slope of the surface of the cleaning blade 56. Therefore, the toner particles are likely to remain at the tip of the cleaning blade 56 or the stepped portion of the surface.

In order to mitigate the above situation, in the present exemplary embodiment, the liquid developer with a low T/D (3.0±0.5 wt % in the present exemplary embodiment) is supplied to the developer supply tank 53, and poured into the upstream of the contact section with the cleaning blade 56 of the developing cleaning roller 58 (flushing). Specifically, a part of the liquid developer supplied to the developer supply tank 53 is caused to flow into the flushing channel 57 provided under the film-forming electrode 51 to achieve a flushing function (arrow D in FIG. 1). By performing flushing, the T/D of the liquid developer collected on the developing cleaning roller 58 drops to a maximum of approximately 10 wt %. As a result, the apparent viscosity of the liquid developer drops down to approximately 8.0 mPa·s, and thus the liquid developer scraped off by the cleaning blade 56 smoothly flows into the developer collection tank 55 without remaining on the surface or the stepped portion.

The liquid developer repelled by the squeeze roller 52 and collected in the developer collection tank 55 from the back surface of the film-forming electrode 51, the liquid developer collected in the developing cleaning roller 58 and collected in the developer collection tank 55 by the flushing and scraping off by the cleaning blade 56, and the liquid developer that has leaked from the developer discharge hole 532 to the developer collection tank 55 are discharged from a developer discharge port 551, and are supplied again to the developer mixing tank 101 via a circulation channel (not illustrated).

In the liquid developer supply circulation system 200, as described above, the liquid developer which concentration is optimized in the developer mixing tank 101 (3.0±0.5 wt % in the present exemplary embodiment) supplied to the developing device 50 by the developer circulation pump 110, A part of the liquid developer supplied to the developer supply tank 53 is collected in the developer mixing tank 101 through the developer collection tank 55 without contributing to image formation. The T/D of the liquid developer depends on the amount of toner consumed in the image formation. Therefore, a liquid developer concentration detection means (not illustrated) is provided in the developer mixing tank 101, and a concentrated developer and the carrier liquid are replenished on the basis of the T/D information acquired by the detection means, so that the VD in the developer mixing tank 101 is controlled so as to fall within the range of appropriate values. In the present exemplary embodiment, as illustrated in FIG. 1, a concentrated developer having a T/D concentration of about 40 wt % is replenished from a concentrated developer container 102 through a buffer (not illustrated), and the carrier liquid is replenished from a carrier liquid tank 103, by a required amount by the metering pumps 111*a* and 111*b*, respectively.

[Image Forming Apparatus]

Next, the configuration of the image forming apparatus in the present exemplary embodiment will be described.

Figure 2:
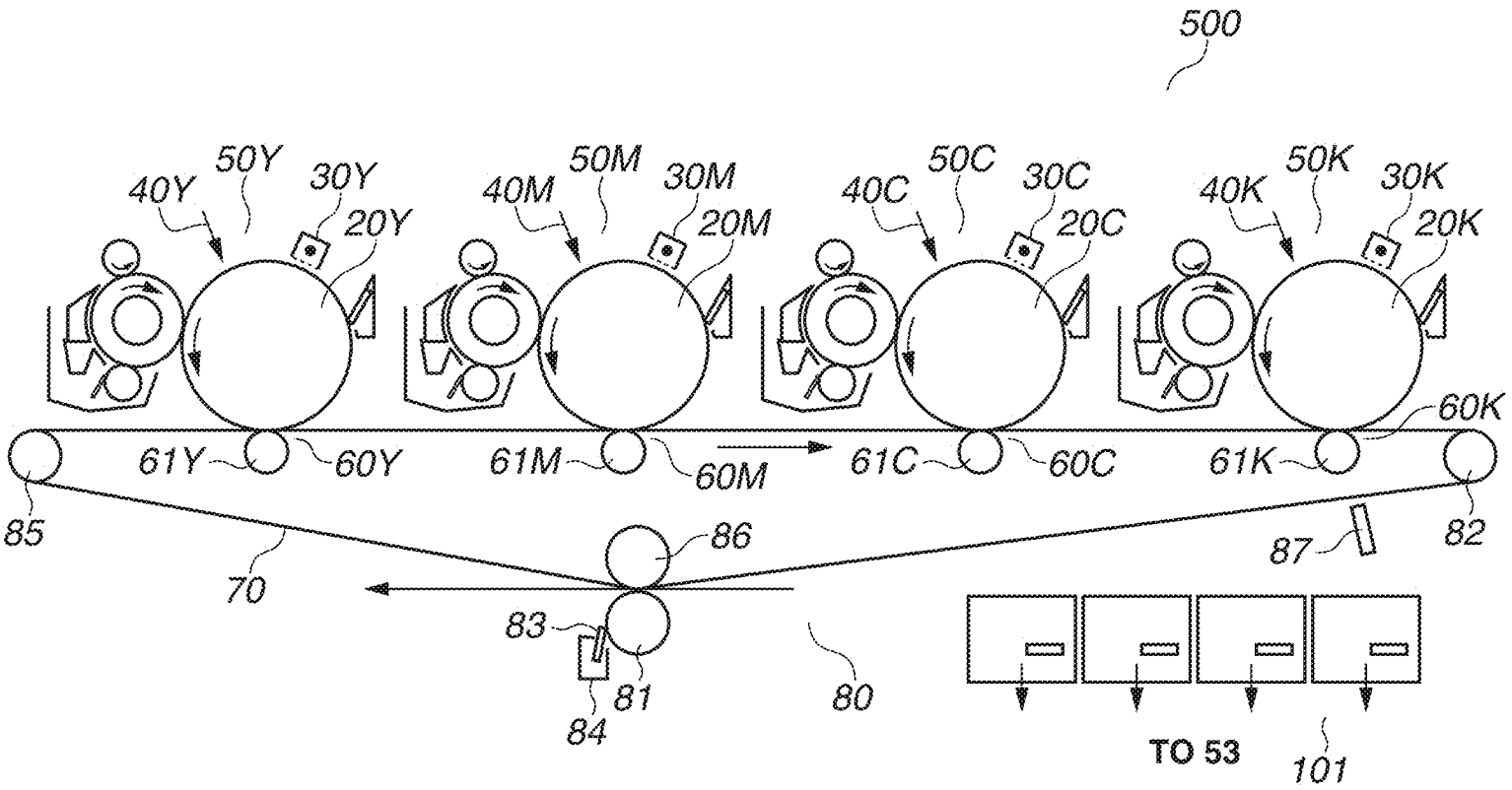
FIG. 2 is a cross-sectional view illustrating main components of an image forming apparatus according to the exemplary embodiment of the present invention.

FIG. 2 is a diagram illustrating the main configuration of an image forming apparatus 100 according to the exemplary embodiment of the present invention. The image forming apparatus 100 is a full color image forming apparatus with four color liquid developers of yellow (Y), magenta (M), cyan (C), and black (K). Four developing devices 50 described in detail above are disposed on top of the intermediate transfer belt 70 in the order of SOY, 50M, 50C, and 50K, from the upstream, as illustrated in FIG. 2.

The intermediate transfer belt 70 is an endless belt stretched around a belt driving roller 82, a driven roller 85, and a secondary transfer inner roller 86, and is driven to rotate while contacting the photoreceptors 20Y, 20M, 20C, and 20K, and a secondary transfer outer roller 81. A primary transfer unit 60Y, 60M, 60C, and 60K include the intermediate transfer belt 70, the primary transfer back-up rollers 61Y, 61M, 61C, and 61K, and the photoreceptors 20Y, 20M, 20C, and 20K. By these units, liquid toners of four colors are transferred in sequence on the intermediate transfer belt 70, and a full color liquid toner image is formed.

The primary transfer unit 60K is a device for transferring a black liquid toner image formed on the photoreceptor 20K to the intermediate transfer belt 70.

The toner image primarily transferred onto the intermediate transfer belt 70 by the primary transfer unit 60K moves to a secondary transfer unit 80. In the secondary transfer unit 80, a voltage of ±1000 V is applied to the secondary transfer outer roller 81. The belt driving roller 82 is kept at 0 V, and the toner particles on the intermediate transfer belt 70 are secondarily transferred onto the surface of a medium such as a paper sheet. The developer remaining on the intermediate transfer belt 70 after the secondary transfer is collected by an intermediate transfer belt cleaning member (not illustrated).

The secondary transfer unit 80 includes the secondary transfer outer roller 81, the intermediate transfer belt driving roller 82, a secondary transfer outer roller blade 83, and a secondary transfer roller cleaning liquid collection unit 84. The secondary transfer unit 80 transfers a monochromatic liquid toner image or full-color liquid toner image formed on the intermediate transfer belt 70 onto a recording medium such as the paper sheet.

On the intermediate transfer belt, a test image for monitoring the image density is regularly drawn during the image forming operation, and the density is detected by a toner image density sensor 87 provided upstream of the secondary transfer unit 80. In the present exemplary embodiment, the toner image density sensor 87 is an optical sensor, and detects the density of the toner image from the intensities of regular reflection light and irregular reflection light of the light emitting diode (LED) light with which the test image is irradiated. The image density is optimized by feedback control on the basis of the density information of the detected toner image. Specifically, the image density is adjusted by adjusting the voltage applied to the film-forming electrode 51.

In a fixing unit (not illustrated), the monochromatic liquid toner image and the full-color liquid toner image transferred on the recording medium are fixed onto the recording medium.

[Operation of Suppressing Increase in Resistance of Developer Carrier Surface Layer]

In the following, a method for embodying the present invention in the present exemplary embodiment will be described.

A. Control System Related to Start Operation of Developing Device

Figure 3:
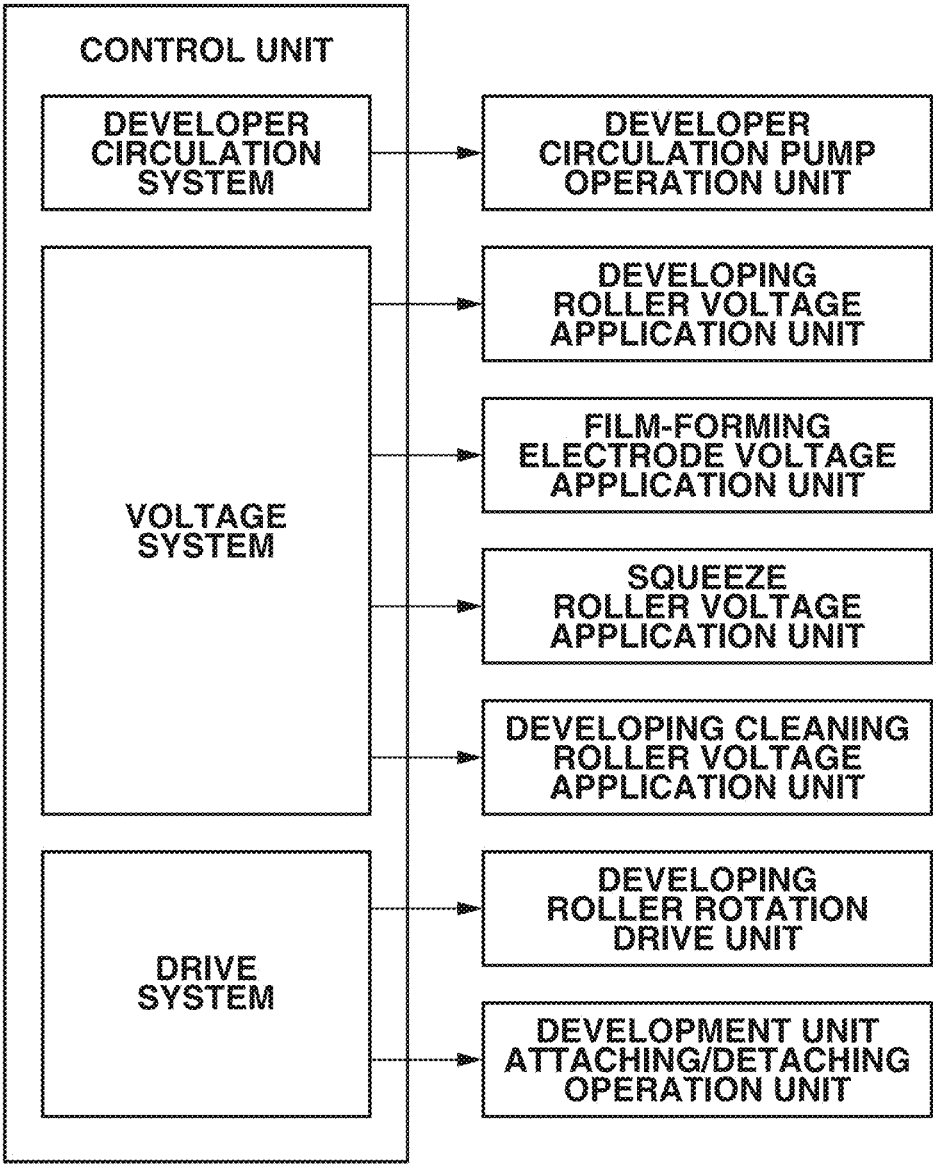
FIG. 3 is a block diagram illustrating a control system according to the exemplary embodiment of the present invention.

In a method of the present invention, the rotational drive of each of the developer circulation pump 110, the developing roller 54, the squeeze roller 52, and the developing cleaning roller 58 for supplying the liquid developer to the developer supply tank 53, and the application of a voltage to each of the developing roller 54, the film-forming electrode 51, the squeeze roller 52, and the developing cleaning roller 58 are appropriately controlled, thereby embodying the present invention. FIG. 3 illustrates a part of the control system of the image forming apparatus 100 according to the present exemplary embodiment, which is necessary to embody the method of the present invention.

In the present exemplary embodiment, the liquid developer is continuously supplied from the developer mixing tank 101 to the developer supply tank 53 at the time of image formation. In doing so, the supplied liquid developer advances to between the film-forming electrode 51 and the developing roller 54 and is borne on the developing roller 54, or advances to the flushing channel 57 and contributes to the flushing on the developing cleaning roller 58. In addition, a part of the liquid developer leaks from the developer supply tank 53 to the developer collection tank 55 through the developer discharge hole 532. When the supply of the liquid developer to the developer supply tank 53 is stopped, the supply of the liquid developer to the developing roller 54 and the flushing channel 57 is stopped. Then, the liquid developer gradually leaks from the developer discharge hole 532, and the developer supply tank 53 finally becomes empty.

During the image forming operation, a voltage is applied to each of the developing roller 54, the film-forming electrode 51, the squeeze roller 52, and the developing cleaning roller 58, which serves as a driving force for the electrophoresis of toner particles. The voltage applied to the developing roller 54, squeeze roller 52, and developing cleaning roller 58 at the time of image formation is −350 V to −300 V, −750 V to −350 V, −150 V to +700 V, respectively, and is appropriately controlled based on the value of the resistivity of the liquid developer or the resistivity of the surface layer of the developing roller 54, or the like. In the present exemplary embodiment, detection means (not illustrated in FIGS. 1 and 2) are provided in the developer mixing tank 101 to detect the resistivity of the liquid developer, and provided around the developing roller 54 to detect the resistivity of the surface layer of the developing roller 54, respectively. The voltage applied to the film-forming electrode 51 is controlled by the image density detected by the toner image density sensor 87 provided on the intermediate transfer belt 70. This is because the mobility of the toner particles in the liquid developer that contributes to image formation (moving speed with respect to the electric field strength) changes depending on the consumption state of the toner particles. In a typical situation, the voltage applied to the film-forming electrode 51 is −600 to −900 V.

The developing roller 54, the squeeze roller 52, and the developing cleaning roller 58 are rotated at substantially the same surface peripheral speed at the time of image formation. The rotation driving force is given to the developing roller 54 by a motor (not illustrated). The driving force is distributed from the developing roller 54 to the squeeze roller 52 and the developing cleaning roller 58 via a gear. Therefore, in the present exemplary embodiment, these three roller members start and stop the rotation operation simultaneously.

The development unit 500 including the developing roller 54 operates so that the developing roller 54 may make contact and separation in the direction of the photosensitive drum 20. In the present exemplary embodiment, during the image forming operation, the developing roller 54 and the photosensitive drum 20 come into contact with each other with a contact pressure of 80±5 kPa. Before and after the image forming operation, the developing roller 54 is separated from the photosensitive drum 20 and the respective operations are stopped.

B. Operation Start Sequence of Developing Device

Next, the operation start sequence of the developing device 50 in the present exemplary embodiment will be described.

Figure 4:
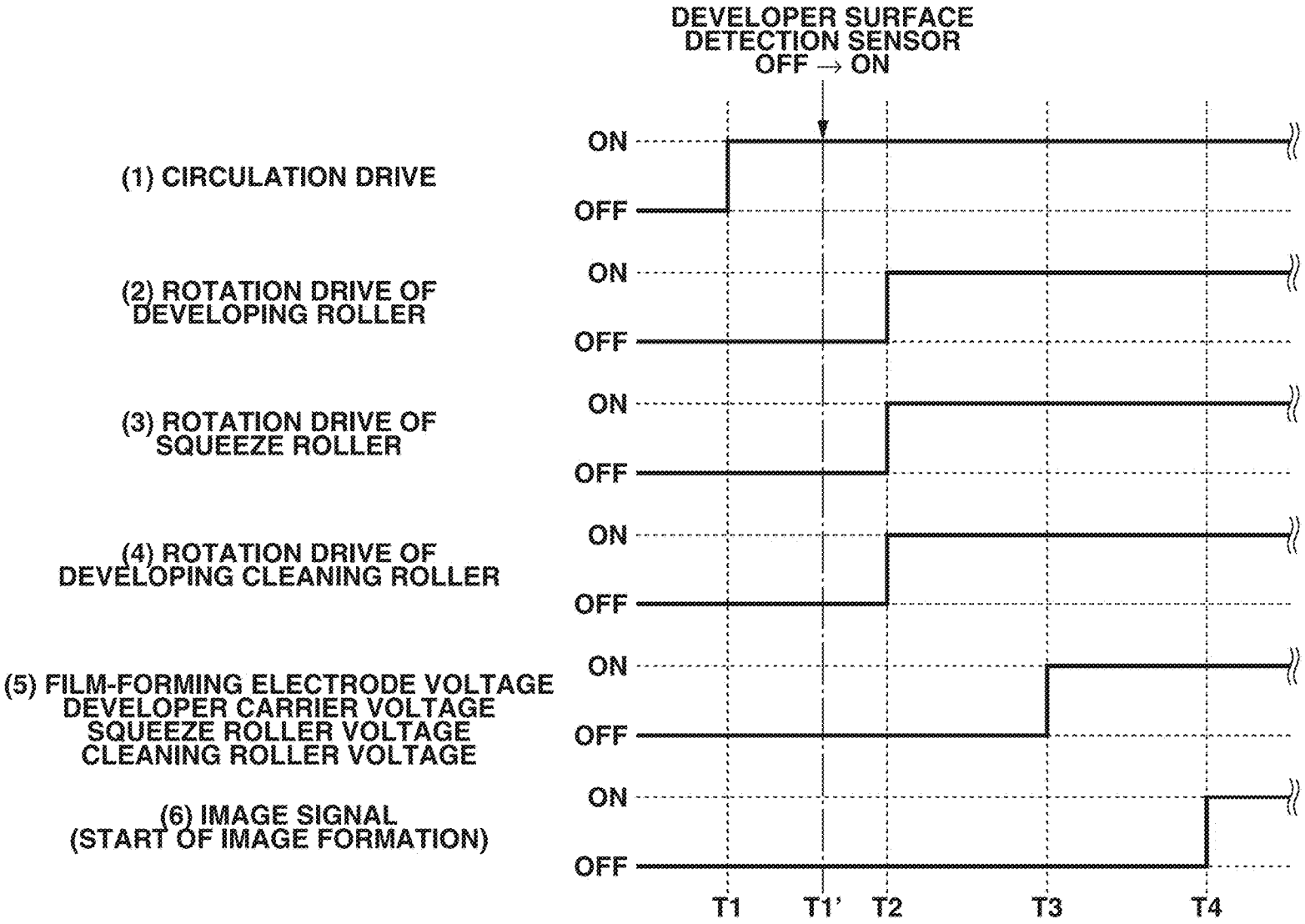
FIG. 4 is a chart illustrating the timing of developer supply, voltage application, and drive start of each member in a first exemplary embodiment (start-up operation).

Specifically, with regard to how to control timing of the supply of the liquid developer from the developer mixing tank 101 to the developer supply tank 53, the rotational drive of the developing roller 54, the squeeze roller 52, and the developing cleaning roller 58, and the application of a voltage to each of the developing roller 54, the film-forming electrode 51, the squeeze roller 52, and the developing cleaning roller 58, to start the image forming operation, the details will be described below with the use of a timing chart illustrated in FIG. 4.

When the developing device 50 is in the stopped state, as described above, the liquid developer leaks from the developer supply tank 53 through the developer discharge hole 532 provided on the bottom surface, and thus the developer supply tank 53 is emptied of the liquid developer.

While the liquid developer is constantly supplied to the surface of the developing roller 54 during the image forming operation, toner particles are removed from the developing roller 54 when the operation is stopped and only the carrier liquid is attached. Just when the operation is stopped, the surface of the developing roller 54 is wet with the carrier liquid, but the carrier liquid evaporates from the surface of the developing roller 54 over time. Therefore, after the operation is stopped for a long time (for example, when the power of the image forming apparatus 100 is turned from OFF to ON), the surface of the developing roller 54 is dry. That is, when the operation is stopped for a long time, the liquid developer is not present in the facing section between the developing roller 54 and the squeeze roller 52, and the liquid developer is not present in the facing section between the developing roller 54 and the developing cleaning roller 58.

The start-up operation of the developing device 50 when the operation is stopped for a long time (when the power of the image forming apparatus 100 is turned from OFF to ON) is started in such a state. Suppose that a bias is applied to each of the developing roller 54, the squeeze roller 52, and the developing cleaning roller 58 in a state where the liquid developer is not present in both the facing section between the developing roller 54 and the squeeze roller 52, and the facing section between the developing roller 54 and the developing cleaning roller 58. In this case, a potential difference is formed in a state where the liquid developer does not intervene between the developing roller 54 and the squeeze roller 52, and a potential difference is formed in a state where the liquid developer does not intervene between the developing roller 54 and the developing cleaning roller 58.

In the start-up operation of the developing device 50, in a case where a potential difference is formed in a state where the liquid developer does not intervene between the developing roller 54 and the squeeze roller 52, an electric current flows between the developing roller 54 and the squeeze roller 52 excessively as compared with the normal image formation in which a potential difference is formed in a state where the liquid developer intervenes between the developing roller 54 and the squeeze roller 52. Similarly, in a case where a potential difference is formed in a state where the liquid developer does not intervene between the developing roller 54 and the developing cleaning roller 58, an electric current flows between the developing roller 54 and the developing cleaning roller 58 excessively as compared with the normal image formation in which a potential difference is formed in a state where the liquid developer intervenes between the developing roller 54 and the developing cleaning roller 58. As a result, the resistance of the elastic layer formed on the surface of the conductive developing roller 54 increases, and the life of the developing roller 54 may be shortened.

Since the start-up operation of the developing device 50 starts from such a state, first, the developer circulation pump 110 is operated to supply the liquid developer contained in the developer mixing tank 101 to the developer supply tank 53 of the developing device 50 (T1).

Next, the rotation operations of the developing roller 54, the squeeze roller 52, and the developing cleaning roller 58 are started (T2). In order to suppress the addition of frictional force that may be applied to the elastic body layer of the surface of the developing roller 54, it is desirable that the rotation operations of developing roller 54, the squeeze roller 52 and the developing cleaning roller 58 that are in contact with the surface of the developing roller 54 are started at the same time. In the present exemplary embodiment, as described above, the squeeze roller 52 and the developing cleaning roller 58 are each so constructed to receive the driving force for rotation operation from the developing roller 54 via the gear, so that the abovementioned purpose is achieved. In a case where the rotation operation of each roller member is given by a separate drive, the timings for starting those rotation operations are aligned as much as possible.

In addition, in each nip section between the developing roller 54 and the squeeze roller 52 and between the developing roller 54 and the developing cleaning roller 58, in order to prevent an excessive current from flowing between the rollers, at the start of the rotation operation of each roller member, a state is formed where the liquid developer is being supplied to each nip section. Therefore, in the present exemplary embodiment, the rotation operations of the developing roller 54, squeeze roller 52, and developing cleaning roller 58 are started when the developer supply tank 53 is filled with the liquid developer, and the output of the developer surface detection sensor 59 provided in the developer supply tank 53 changes from OFF to ON (that is, the presence of the liquid developer is detected by the developer surface detection sensor 59). Alternatively, in the present exemplary embodiment, the rotation operations of the developing roller 54, squeeze roller 52, and developing cleaning roller 58 are started when a predetermined time has elapsed after the output of the developer surface detection sensor 59 provided in the developer supply tank 53 changes from OFF to ON (that is, after the developer surface detection sensor 59 detects the presence of the liquid developer).

In the example of the sequence illustrated in FIG. 4, the time that the output of the developer surface detection sensor 59 changes from OFF to ON is T1' and after a predetermined time (T2-T1') has elapsed from T1', the rotation operations of the developing roller 54, squeeze roller 52, and developing cleaning roller 58 are started.

Then, the developing roller 54 rotates at least once after starting the rotation operation of the developing roller 54. As a consequence, in each nip section between the developing roller 54 and the squeeze roller 52 and between the developing roller 54 and the developing cleaning roller 58, the liquid developer is present.

A variation may be employed in which the developing roller 54, squeeze roller 52, and developing cleaning roller 58 start rotating at the same time as start of the operation of the developer circulation pump 110 when the developing device 50 starts up. However, in this variation, in a state where the liquid developer is not present in each nip section between the developing roller 54 and the squeeze roller 52 and between the developing roller 54 and the developing cleaning roller 58, a period during which the developing roller 54, squeeze roller 52, and developing cleaning roller 58 rotate becomes longer. Therefore, until the liquid developer reaches each nip section between the developing roller 54 and the squeeze roller 52 and between the developing roller 54 and the developing cleaning roller 58, the amount of frictional force added to the elastic body layer on the surface of the developing roller 54 increases.

Therefore, in terms of suppressing the abrasion of the elastic body layer on the surface of the developing roller 54, in the start-up operation of the developing device 50, it is preferable to delay the start timing of the rotation operations of the developing roller 54, squeeze roller 52, and developing cleaning roller 58 with respect to the start timing of the operation of the developer circulation pump 110, rather than starting the rotation operations of the developing roller 54, squeeze roller 52, and developing cleaning roller 58 simultaneously with the start of the operation of the developer circulation pump 110. In the present exemplary embodiment, a start timing (T2) of the rotation operations of the developing roller 54, squeeze roller 52, and developing cleaning roller 58 is set to 6.0 s after a start timing (T1) of the operation of the developer circulation pump lift 110.

The application of a voltage to each of the developing roller 54, the film-forming electrode 51, the squeeze roller 52, and the developing cleaning roller 58 is started (at T3: T3 being 2.0 s after T2 in the present exemplary embodiment) after the developing roller 54 rotates at least once (preferably, after the developing roller 54 rotates once or more, and the rotation operations of the developing roller 54, the squeeze roller 52, and the developing cleaning roller 58 have become stable), in a state where the liquid developer has reached the supply position on the developing roller 54, to which the liquid developer is supplied from the developer supply tank 53. When applying the voltage to each member, it is desirable that a slight time difference is given to the application timing so that the magnitude relation of the potential may not reverse, considering the rising speed of the voltage. According to the present exemplary embodiment, although not described in detail in FIG. 4, the voltage is applied to the film-forming electrode 51, squeeze roller 52, developing cleaning roller 58, and the developing roller 54 in this order by shifting the timing by 0.5 s.

After the state of the developer on the developing roller 54 is stabilized, a latent image is formed on the photosensitive drum 20 by the exposure unit 40, and an image is actually formed (at T4: T4 being 3.0 s after T3 in the present exemplary embodiment).

Figure 5:
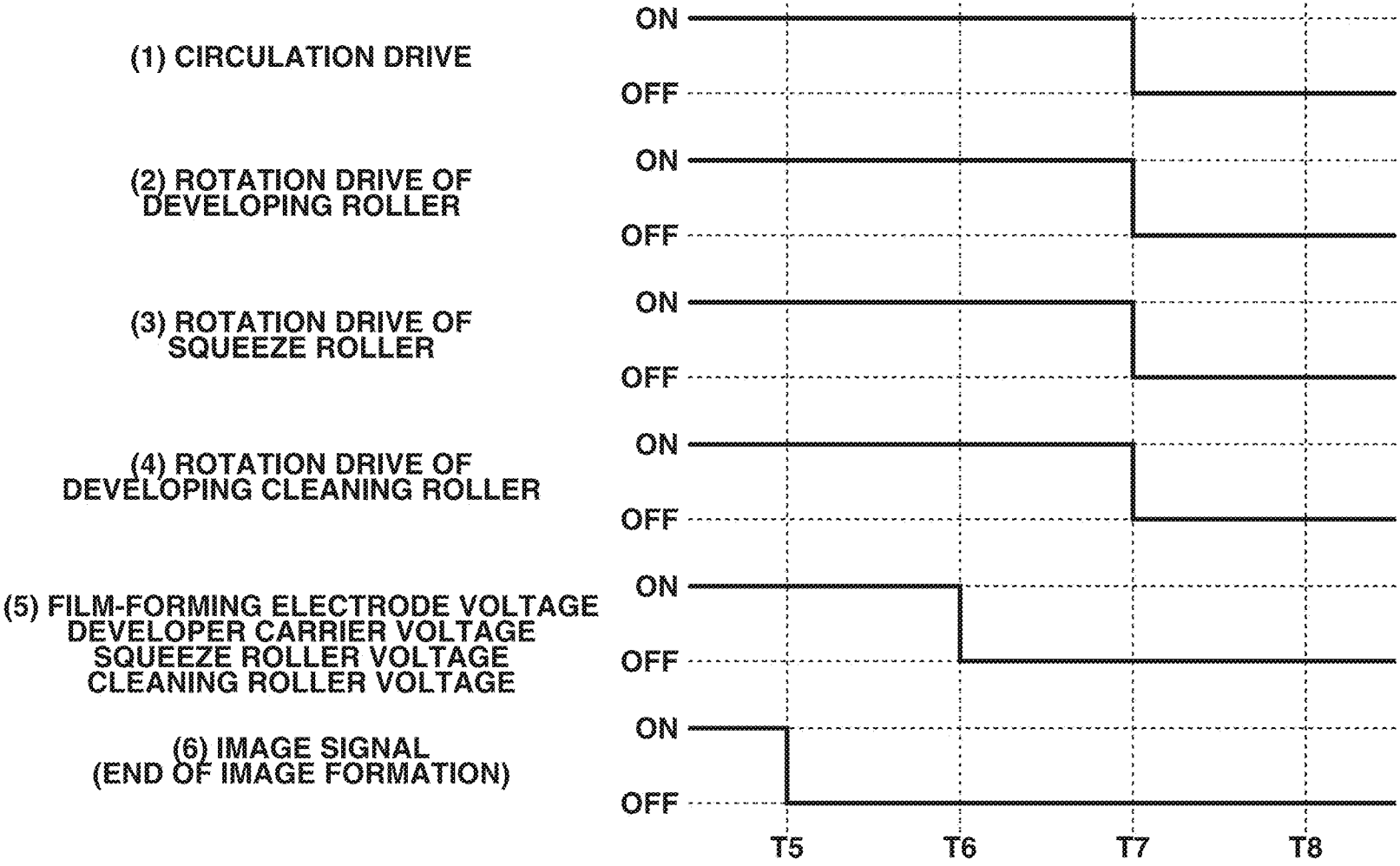
FIG. 5 is a chart illustrating the timing of developer supply, voltage application, and drive stop of each member in the first exemplary embodiment (shut-down operation).

Next, FIG. 5 illustrates the sequence at the end of operation (at the time of shut-down operation). Basically, the timing is opposite to the timing at the start (at the time of start-up operation). Each high voltage is turned off 1.0 s after T5 (at T6). After that, the driving is stopped when 2.0 s have elapsed (at T7). Finally, the circulation is stopped (at T8).

In order to confirm the effect of the present exemplary embodiment, the resistance variations of the developing roller 54 in the following cases were compared: (1) a case where the operation of the developing device 50 was started and ended by the method of the present exemplary embodiment; (2) a case where the operation of the developing device 50 was started and ended when the roller driving and the high voltage application were performed at the same timing; and (3) a case where the roller driving and the high voltage application were performed at a timing opposite to the timing of the present exemplary embodiment. Specifically, the image was not formed on the photosensitive drum 20, but image formation on an A4-size sheet was performed 10,000 times and the volume variations of the developing roller 54 were measured, which occurred during the performance of the image formation.

First, in any of the cases, the volume resistivity of the developing roller 54 at the initial stage was 1.0E7 Ω·cm. In case (1) of the present exemplary embodiment, the volume resistivity after image-forming 10,000 times was 7.2E7 Ω·cm, which is not much changed. Meanwhile, in case (2) where the roller driving and the high voltage application were performed at the same tithing, the volume resistivity was 1.0E8 Ω·cm, which is a single-digit increase. In addition, in case (3) where the roller was driven after the high voltage was applied, the volume resistivity was 1.0E9 Ω·cm, which is almost a double-digit increase.

Figure 6:
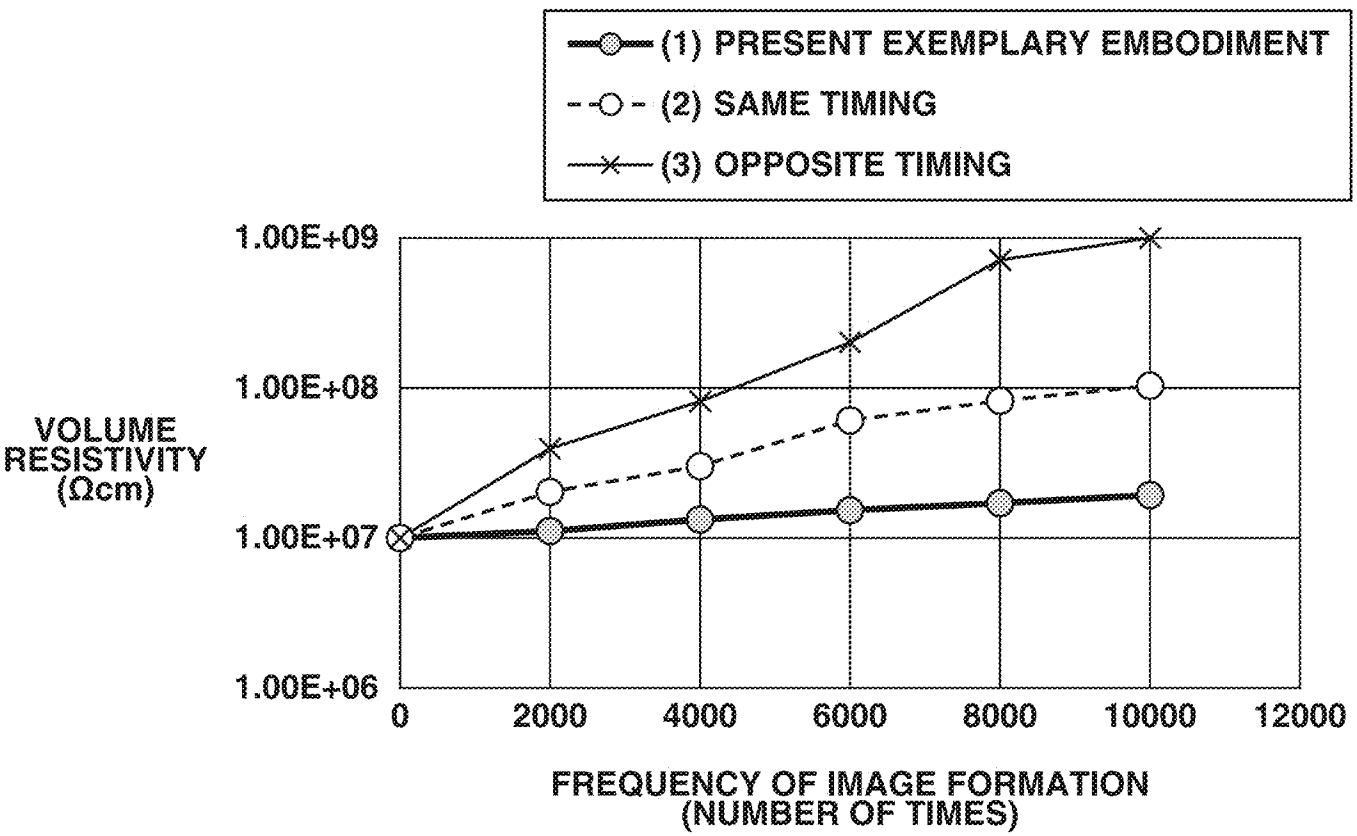
FIG. 6 is a graph for explaining an effect of the first exemplary embodiment.

As described above, it is desirable that a developing roller 54 having a volume resistivity of less than 1.0E9 Ω·cm is used, and the effect of the present exemplary embodiment is much larger than the effect indicated in FIG. 6.

In the present exemplary embodiment, a high voltage is applied after the driving of the developer carrier becomes stable. However, it is also possible to shorten the time to apply a high voltage and shorten the time to form an image by applying a high voltage stepwise at the same time as the driving.

In addition, here, in order to confirm the effect of the present embodiment, the damage degree of the elastic layer on the surface of the developing roller 54 was compared between a case where the operation of the developing device 50 was started by the method of the present exemplary embodiment and a case where the operation of the developing device 50 was started by another method. Specifically, without forming no image on the photosensitive drum 20, at every period corresponding to the image formation of 150 copies of A4 size, the following was repeated: the supply of the liquid developer to the developer supply tank 53; the rotational drive of the developing roller 54, the squeeze roller 52, and the developing cleaning roller 58; and applying and stopping the applying of voltage to each of the developing roller 54, the film-forming electrode 51, the squeeze roller 52, and the developing cleaning roller 58. After that, a change in surface roughness Ra of the elastic layer on the surface of the developing roller 54 was checked. In both cases, the initial surface roughness Ra of the developing roller 54 was 0.20 μm. The results are illustrated in FIG. 7.

Figure 7:
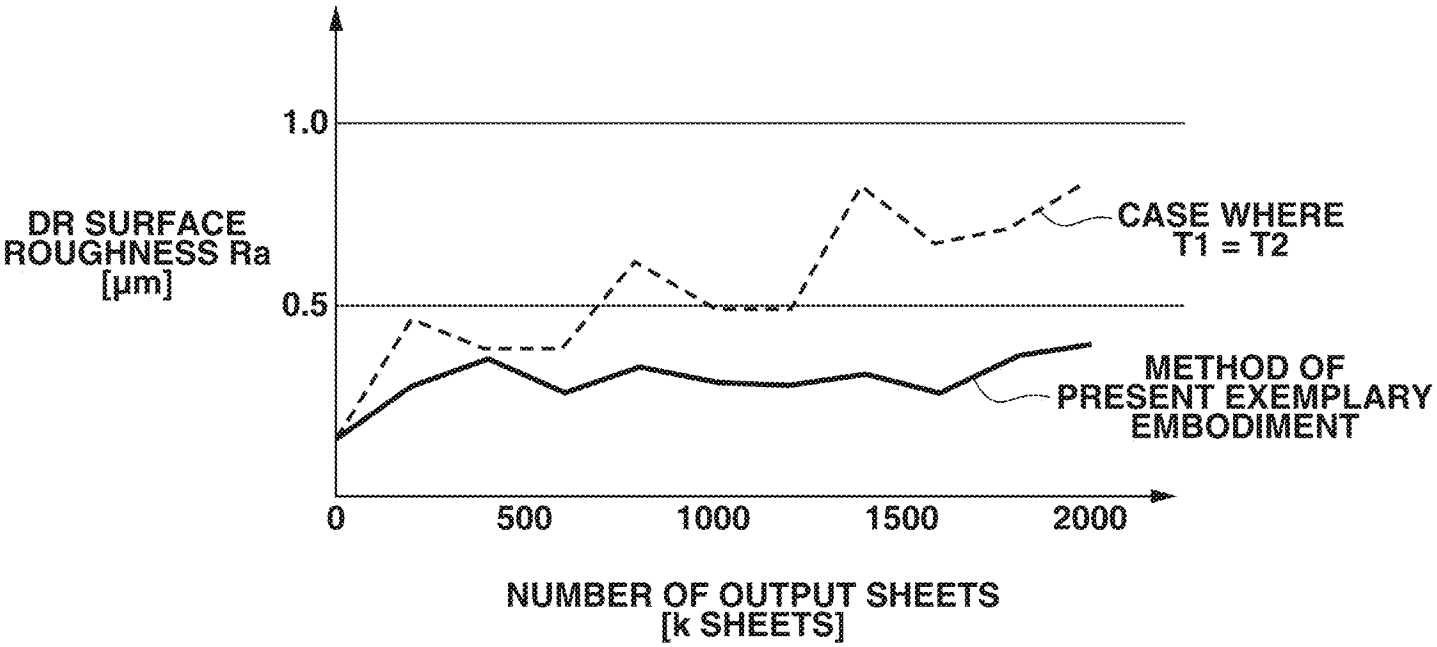
FIG. 7 is a graph for explaining an effect of the first exemplary embodiment.

First, in a case where the operation of the developing device 50 is started by the method of the present exemplary embodiment, as indicated by the solid line in FIG. 7, the increase in the surface roughness Ra of the elastic layer on the surface of the developing roller 54 was only slight from the initial 0.20 μm to 0.38 μm during the operating time corresponding to 2000 k sheets.

In a case where, as another operation start sequence of the developing device 50, the supply of the liquid developer to the developer supply tank 53 and the rotational drive of the developing roller 54, the squeeze roller 52, and the developing cleaning roller 58 were started at the same time (corresponding to T1=T2 in FIG. 4), the endurance change of the surface roughness Ra of the elastic layer on the surface of the developing roller 54 has been confirmed. The result was, as indicated by the dotted line in FIG. 7, that the surface roughness Ra of the elastic layer on the surface of the developing roller 54 increased to 0.79 μm during the operating time corresponding to 2000 k sheets.

From the above, it has been shown that the mechanical stress (mainly friction) applied to the elastic body layer on the surface of the developing roller 54 is suppressed, and the life of the developing roller 54 is prolonged by the use of the method of the present exemplary embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2019-187211, filed Oct. 11, 2019, and No. 2019187212, filed Oct. 11, 2019, and No. 2020-132815, filled Aug. 5, 2020, which are hereby incorporated by reference herein in their entirety.

What is claimed is:

1. An image forming apparatus comprising:

an image bearing member;

an exposure device configured to expose the image bearing member to light to form an electrostatic latent image on the image bearing member;

a developing device including:

a developing roller that is conductive and carries and feeds a liquid developer including toner and a carrier liquid to a developing position, where the electrostatic latent image formed on the image bearing member is developed, an elastic layer being formed on a surface layer of the developing roller;

a developer container containing the liquid developer, which is supplied to the developing roller;

a squeeze roller that is conductive and is configured to regulate an amount of the liquid developer carried by the developing roller, the squeeze roller contacting the developing roller, the squeeze roller being disposed downstream from a supply position on the developing roller, to which position the liquid developer is supplied from the developer container, and upstream from the developing position, in a rotation direction of the developing roller; and a cleaning roller that is conductive and is configured to remove the toner in the liquid developer carried by the developing roller, the cleaning roller contacting the developing roller, the cleaning roller being disposed downstream from the developing position and upstream from the supply position, in the rotation direction of the developing roller;

a supply device configured to supply the liquid developer to the developer container;

a voltage application unit configured to apply a voltage to each of the developing roller, the squeeze roller, and the cleaning roller, to generate an electric field in which a normally charged toner in the liquid developer moves from the squeeze roller toward the developing roller, at a first contact position where the developing roller and the squeeze roller are in contact with each other, and generate an electric field, in which the normally charged toner in the liquid developer moves from the developing roller toward the cleaning roller, at a second contact position where the developing roller and the cleaning roller are in contact with each other; and a developing roller rotation drive unit configured to rotationally drive each of the developing roller, the squeeze roller, and the cleaning roller, wherein, in a start-up operation of the developing device, which is performed after a power of the image forming apparatus is turned from OFF to ON and before the exposure device starts to expose the image bearing member, the developing roller rotation drive unit rotationally drives each of the developing roller, the squeeze roller, and the cleaning roller in a state where the liquid developer supplied to the developer container by the supply device has reached the supply position, the voltage application unit applies the voltage to none of the developing roller, the squeeze roller, and the cleaning roller until the developing roller rotates by 360° at least once after the developing roller rotation drive unit starts rotational driving of the developing roller in a state in which the liquid developer supplied to the developer container by the supply device has reached the supply position, and the voltage application unit applies the voltage to each of the developing roller, the squeeze roller, and the cleaning roller after the developing roller rotates by 360° at least once after the developing roller rotation drive unit starts the rotational driving of the developing roller in the state in which the liquid developer supplied to the developer container by the supply device has reached the supply position.

2. The image forming apparatus according to claim 1, further comprising a sensor configured to detect the liquid developer contained in the developer container, wherein, in the start-up operation of the developing device, the developing roller rotation drive unit rotationally drives each of the developing roller, the squeeze roller, and the cleaning roller when the sensor detects the liquid developer supplied to the developer container by the supply device.

3. The image forming apparatus according to claim 1, further comprising a sensor configured to detect the liquid developer contained in the developer container, wherein, in the start-up operation of the developing device, the developing roller rotation drive unit rotationally drives each of the developing roller, the squeeze roller, and the cleaning roller after a predetermined time elapses since the sensor detects the liquid developer supplied to the developer container by the supply device.

4. The image forming apparatus according to claim 1, wherein, in the start-up operation of the developing device, the developing roller rotation drive unit rotationally drives each of the developing roller, the squeeze roller, and the cleaning roller concurrently with supply of the liquid developer to the developer container by the supply device.

5. The image forming apparatus according to claim 1, wherein the voltage application unit applies the voltage to the squeeze roller, the cleaning roller, and the developing roller in this order.

6. The image forming apparatus according to claim 1, wherein the developing device further includes an electrode disposed downstream from the supply position and upstream from the first contact position in the rotation direction of the developing roller, and arranged to face the developing roller with a predetermined gap, and wherein the voltage application unit applies the voltage to each of the developing roller and the electrode to generate an electric field, in which the normally charged toner in the liquid developer moves from the electrode toward the developing roller, at a facing position, where the developing roller and the electrode face each other.

* * * * *